United States Patent [19]

Kucharczyk

[11] 4,420,905

[45] Dec. 20, 1983

[54] CLOSURE HARDWARE

[75] Inventor: Eckard Kucharczyk, Netphen, Fed. Rep. of Germany

[73] Assignee: Siegenia-Frank KG, Fed. Rep. of Germany

[21] Appl. No.: 132,073

[22] Filed: Mar. 20, 1980

[30] Foreign Application Priority Data

May 21, 1979 [DE] Fed. Rep. of Germany ..... 2920581

[51] Int. Cl.[3] ..... E05B 65/06; E05C 19/02; E05C 9/10; E05C 1/12

[52] U.S. Cl. ..... 49/192; 49/394; 292/33; 292/139; 292/140; 292/177; 292/182; 292/DIG. 49; 292/198

[58] Field of Search ..... 49/192, 394, 395; 292/182, 177, 146, 140, 138, 33, DIG. 49

[56] References Cited

U.S. PATENT DOCUMENTS

| | | | |
|---|---|---|---|
| 529,388 | 11/1894 | Johnston | 292/DIG. 49 |
| 954,806 | 4/1910 | Hoes | 292/182 X |
| 2,022,081 | 11/1935 | Ellison | 292/146 X |
| 2,094,990 | 10/1937 | Lang | 49/395 X |
| 2,157,016 | 5/1939 | Reynaud | 292/146 X |
| 2,189,992 | 2/1940 | Pearce | 292/DIG. 49 |
| 3,085,299 | 4/1963 | Reynaud | 49/394 X |
| 3,949,525 | 4/1976 | Bates et al. | 292/140 X |
| 4,208,838 | 6/1980 | Kleine et al. | 49/192 |
| 4,223,928 | 9/1980 | Roth | 49/394 X |

FOREIGN PATENT DOCUMENTS

| | | | |
|---|---|---|---|
| 207725 | 2/1960 | Austria | 292/146 |
| 342584 | 10/1921 | Fed. Rep. of Germany | 292/182 |
| 1086147 | 7/1960 | Fed. Rep. of Germany | 49/192 |
| 1193833 | 5/1965 | Fed. Rep. of Germany | 49/192 |
| 2242305 | 3/1974 | Fed. Rep. of Germany | 49/192 |
| 11378 | of 1901 | United Kingdom | 292/182 |

*Primary Examiner*—Cornelius J. Husar
*Assistant Examiner*—Carl F. Pietruszka
*Attorney, Agent, or Firm*—Blodgett & Blodgett

[57] ABSTRACT

A latching mechanism for a window or door closure hingedly mounted on a fixed frame comprising a control cam and catch fixed to the hinged side of the frame, a driving rod slidably mounted on the closure, a dog mounted on one end of the driving rod for latchingly engaging the catch, and a cam follow mechanism connected to the opposite side of the driving rod for engaging the control cam so that the dog is moved by the driving rod in latching alignment with the catch when the closure is moved to the closed position relative to the frame.

10 Claims, 13 Drawing Figures

CLOSURE HARDWARE

BACKGROUND OF THE INVENTION

The object of this invention is the provision of a latching mechanism for closures for windows and doors that have turning or tilting closures. This invention is particularly concerned with a latching mechanism that is arranged on the hinge side of such windows and doors, which device is engaged in the closed position of the locked closure, but which must be disengaged for swing opening and tilt opening of the wing, as with any other latching mechanism. The invention provides for the engaging-and disengaging of the latching mechanism to take place automatically by the movement of the closure around its hinge axis. The invention has to do with a latching mechanism consisting of a fixed control cam and catch mounted to a fixed frame, and of a dog which is mounted on and movable with the closure relative to the frame.

The guidelines for window and door design provide that center closure latches must be added to the hinge sides of windows and doors as soon as the design length exceeds 1200 mm. These center closure latches prevent excessive bending of the closure frame relative to the frames which are anchored within the building walls, thus bringing about tightness of windows and doors.

The center closing latches for windows and doors are commonly engaged and disengaged by hand-lever drives with movable drive rods, through which the other functions of windows of doors are also accomplished, these functions being the locking and unlocking of the closure device, or the adjustment of the linkage axis for turn-and tilt opening of the wing. Fittings of this type have been made known through the German patent DE-AS No. 10 86 147.

In order that a prior art installation operate the hinge side center closure latching mechanism, it is necessary to provide corner tracks and these require installation space, which is not always readily available, particularly if the windows and doors are made from light metal-or hollow-plastic profiles, because the relatively small space between wing and fixed frame must also be used for the fittings for other functions.

The German patent DE-AS No. 11 93 833 shows the use of a latching mechanism for the necessary engagement and disengagement of a set-out latch for the turn-tilt opening of the closure. These are independent of the operating force working over a hand lever drive to the driving rods; that is, they work independently. This latching mechanism, however, is only engaged or disengaged during the opening and closing operation of the closure about its turning or vertical hinge axis; during the opening and closing operation around the horizontal or tilt axis of the closure, it does not operate at all. The operation of the latching mechanism is activated hereby in the area of the tilt axis by control cams and control areas, and is carried over to a place located far from the tilt axis in the vicinity of the upper horizontal closure edge. A closure-locking function, however, is not achieved, because of the necessary pressure between the closure and the fixed frame.

Austrian patent AT-PS No. 207 725 also shows a closure device with a turning linkage for the corners of windows and doors with turn-tilt closures. These work along the horizontal or tilt axis in oppositely-positioned upper horizontal groove areas of closure and frame. They are also dependent upon displacement movements of the closure about its hinge axis, opposite the fixed frame, by the coworking of a fixed control cam with a movable latch element. In that way the closure pressure generated by a corner drive and fixed frame, is carried over to the upper closure corner near the hinge axis of the closure without the use of a corner track. For the turn-joint side center closure between the closure and the fixed frame, however, a special pressure device is provided operated by a hand lever. The operation of this known corner closure device is based upon the fact that the latching movement is mainly brought out horizontally and is separately operated at the hinge axis and engaged with the center closure device.

German patent application No. P29 04 942.1 has a suggestion which is older and consists of the use of a control cam fixedly-mounted on the fixed frame and a movable dog mechanism guided on the closure, these being movable at a right angle to each other and exclusively by the movement of the closure around its hinge axis relative to the fixed frame. It is operated as a latching mechanism for automatic engagement and disengagement of center closures latches of windows and doors with turning and tilting closures wherein, the latching movement is connected to the corresponding joint axis of the nearest center closure device.

This type of latching mechanism for engaging-and disengaging centrally-located latches in latched position of the window or door, prevents an excessive bending of the closure struts relative to the struts anchored to the building walls. However, since the cooperating surfaces of the latch dog and latch catch of the centrally-located latches (according to the old solution) are formed with wedge surfaces opposite each other and sloped in the same direction, the optimum action effect of the center closure latches depends on an exact installation of all functional parts. Therefore, adjustments after installation of the functional parts cannot be completely eliminated.

A principle object of the present invention is the provision of a latching mechanism having improved operation and at the same time provides better mounting and post-installation adjustment. Therefore, the basis of this invention is a latching mechanism for engage-and disengaging of a latch on closures, especially centrally-located latches used with doors and windows of the described type.

SUMMARY OF THE INVENTION

A latching mechanism for a window or door closure hingedly monted on a fixed frame comprising a control cam and catch fixed to the hinged side of the frame, a driving rod slidably mounted for movement along its longitudinal axis on the hinged side of the closure, a dog mounted on one end of the driving rod for latchingly engaging the catch, and a cam follower mechanism connected to the opposite side of the driving rod for engaging the control cam so that the dog is moved by the driving rod in latching alignment of the catch when the closure is moved to the closed position relative to the frame.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
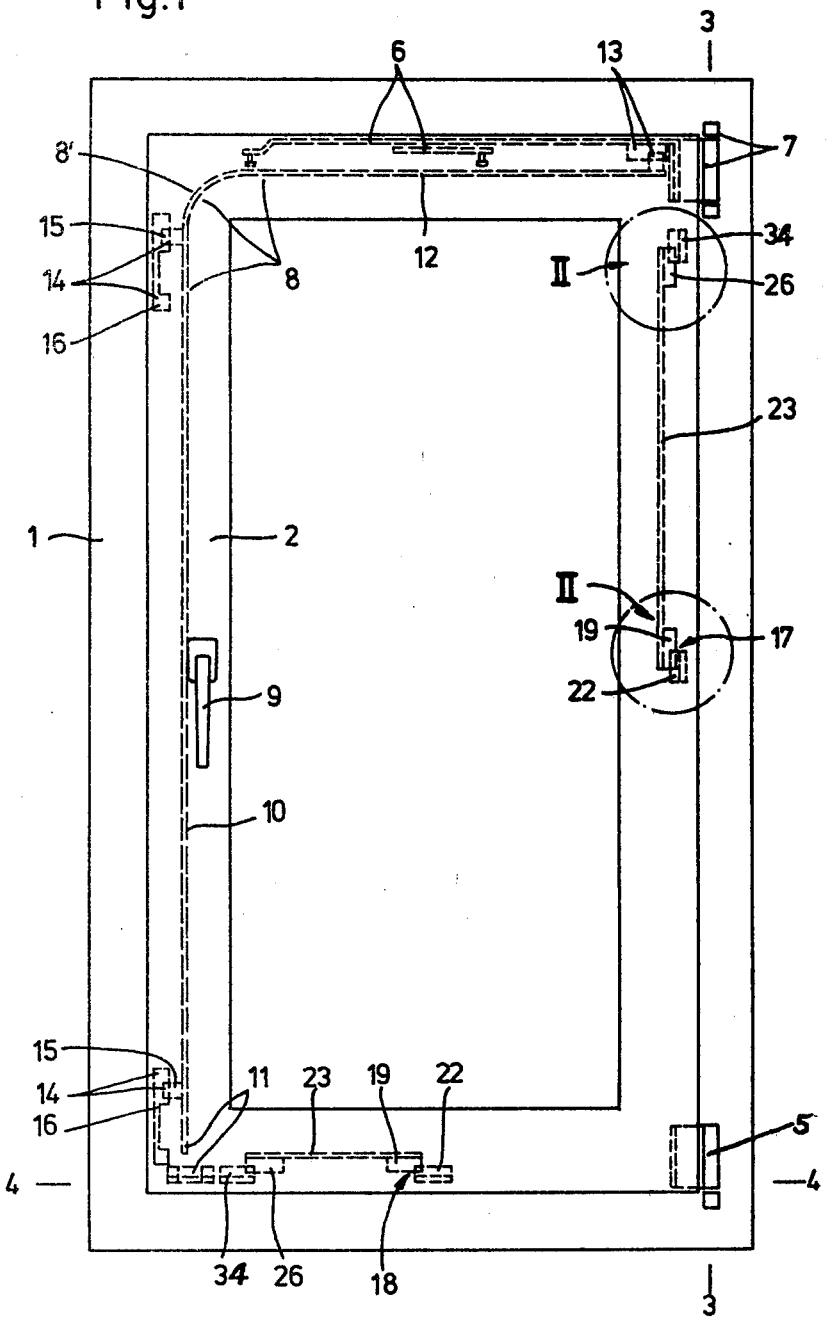
FIG. 1 is a front elevational view of a turn-tilt window, which is equipped near its vertical turn axis and near its horizontal tilt axis with a central closure latching system.

FIG. 1 shows a window consisting of a fixed frame 1 and a closure 2. The closure 2 is hingedly connected to the frame to permit turning or tilting of the closure. The closure may be opened relative to the fixed frame by swinging or turning about a vertical side hinge axis 3—3, and also swinging or tilting about a lower horizontal tilt hinge axis 4—4. To accomplish this, the closure 2 is supported on the fixed frame 1 on a turn-tilt corner support 5 at the intersection of the vertical or turn hinge axis 3—3 and the horizontal tilt or hinge axis 4—4. It is also held in place by an extension bracket 6. On one hand, this bracket is held to swing in line with the vertical hinge axis 3—3 through a support bearing 7 on the fixed frame 1; on the other hand, this bracket engages the closure 2 in such a way that it does not prevent the tilting movement about the horizontal axis 4—4 relative to the fixed frame 1 and, during the swinging movement of the closure introduces its weight into the support bearing 7.

For the control of the turning and tilting function of the closure 2, a drive rod fitting 8 is built into the closure 2, the fitting being operated by a service handle 9. In that way, a tilt locking device 11 can be engaged and disengaged by the drive rod 10. Through a drive rod 12, the extension bracket 6 is fastened to the closure in the vicinity of the support bearing 7 for swing opening through a coupling device or locking arrangement 13. However, for the tilting opening the extension bracket 6 is disconnected. A corner track 8' connects the two drive rods 10 and 12, so that they are movable at a right angle to one another.

In order that the closure 2, when the window is closed, is located tightly in the fixed frame 1, the closure devices or edge center locking arrangements 14 are added to the drive rod 10 of drive rod fitting 8, the arrangement consisting of closure cams 15 mounted on the drive rod 10 and with it lock members 16, also mounted on the fixed frame 1.

If the height or width of the window exceeds the corresponding closure struts by a length of 1200 mm, then additional closure devices are provided between closure 2 and the fixed frame 1 on the edges running parallel to the turn axis 3—3 and/or to the tilt axis 4—4. These additional closure devices are edge center closure latching mechanisms 17 and 18. The latching mechanisms 17 and 18 serve to prevent excessive bending of the vertical and horizontal closure struts relative to the neighboring frame struts due to wind pressure, and to assure sufficient tightness of the window in the closed position of the closure.

In FIG. 1 it can be seen that the two center latches 17 and 18 are functionally independent of the drive rod fitting and are therefore not engaged or disengaged by the displacement of the driving rods 10 and 12.

Figure 2:
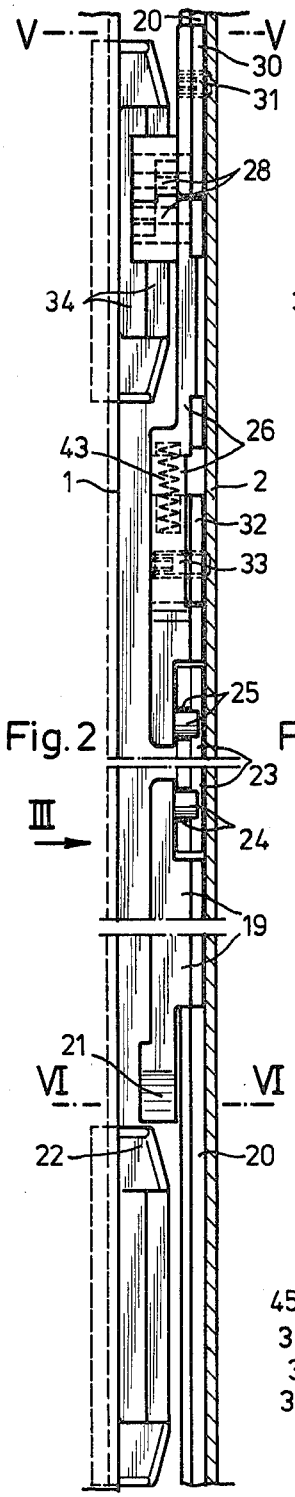
FIG. 2 is an enlarged, approximately full-size elevational view of part of an edge center closure locking device indicated in FIG. 1 as II.
Figure 9:
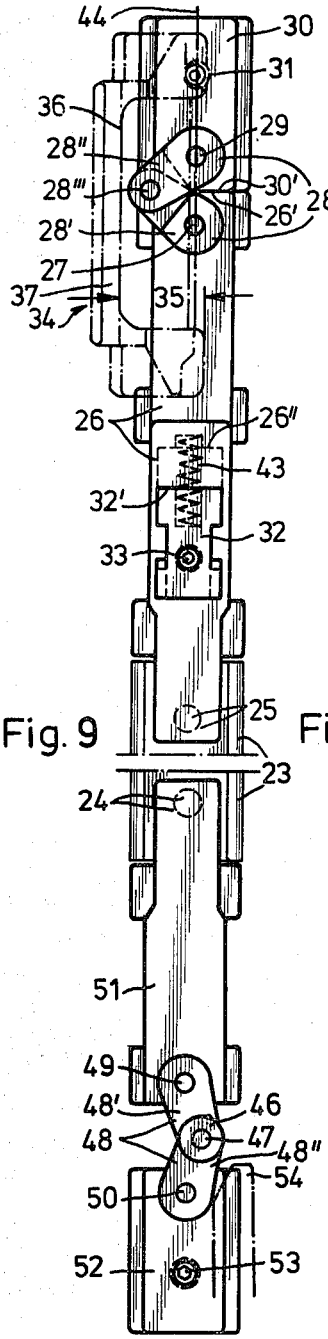
FIGS. 9 and 10 show a first modified central closure latching device.
Figure 10:
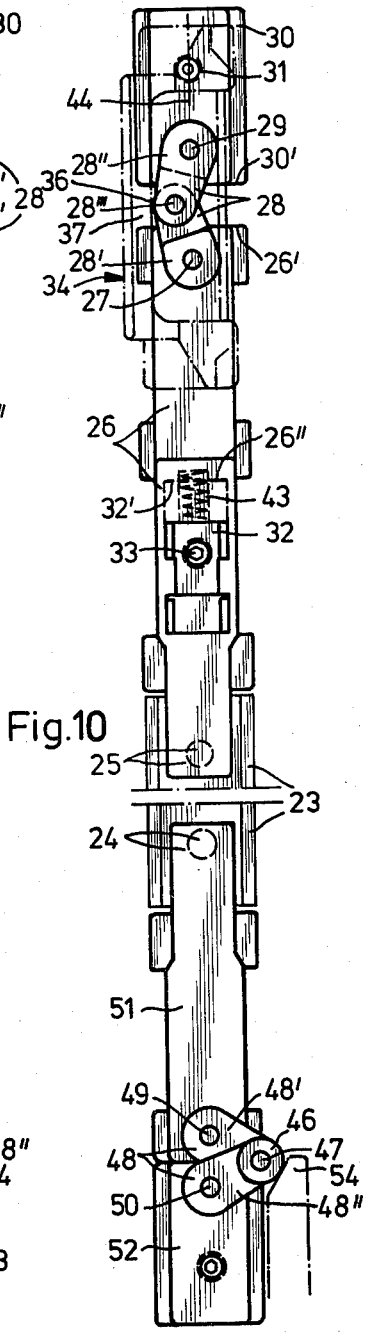
Figure 11:
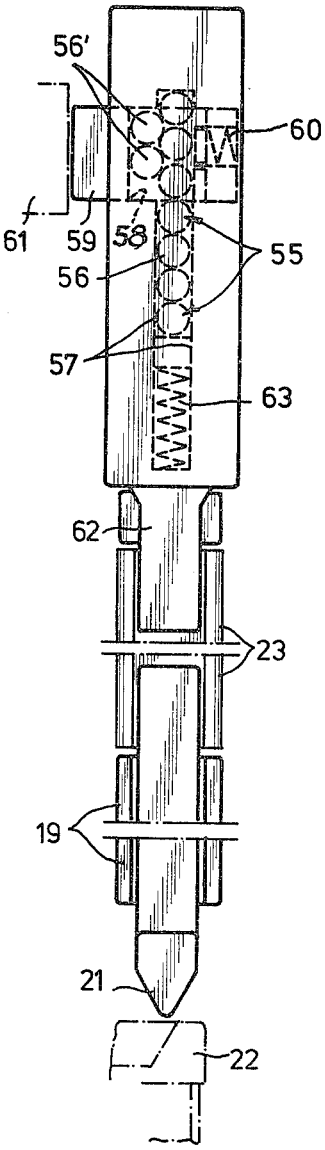
FIGS. 11 and 12 show a second modified central closure latching device.
Figure 12:
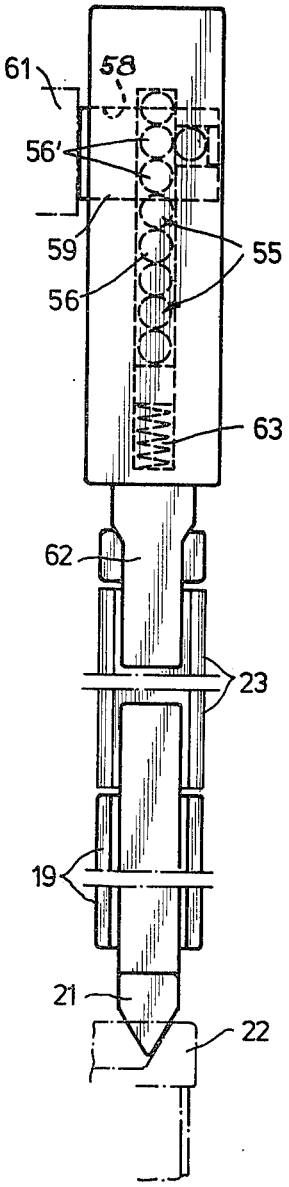
Figure 13:
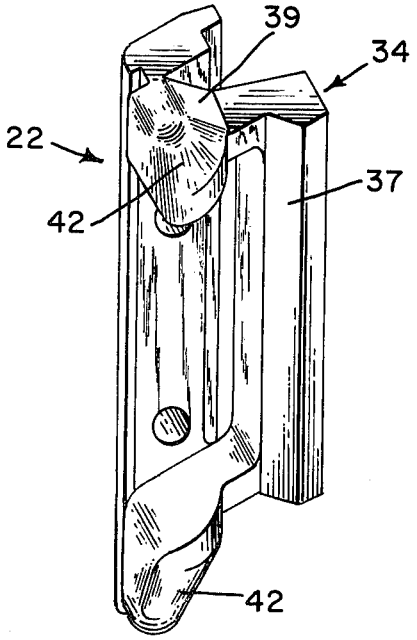
FIG. 13 is an isometric view of a fixture which includes the catch and control cam elements.

The design and operation of the center latches 17 and 18 can be seen in FIGS. 2 and 12 of the drawings. A preferred design of the edge center closure latches 17 and 18 can be seen in FIGS. 2 to 8. A first modified edge center closure latch is shown in FIGS. 9 and 10, while FIGS. 11 and 12 show a second modified closure latch.

All embodiments of the edge center closure latches 17 and 18 shown in the drawings can be used in connection with windows or doors built from metal or plastic hollow profiled bars, containing undercut guide grooves for driving rods. Naturally, it is possible to design center latching devices by the use of known design details which may be built into window, doors, etc., consisting of plastic and wood profile bars which do not have undercuts, but provide step type offset profile grooves for insertion of fittings.

Figure 8:
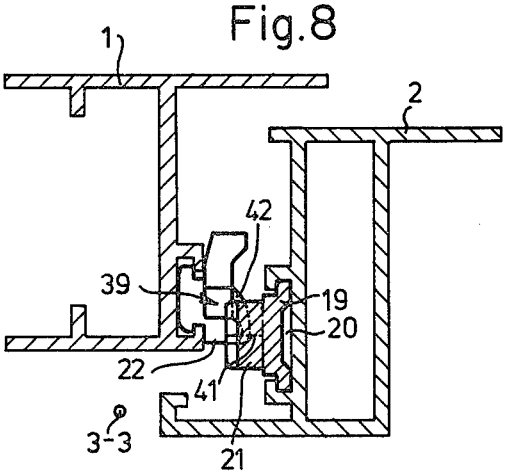

In the embodiment shown in FIGS. 2 and 8, the edge center closure latch 17 is equipped with a slide 19 which is inserted into an undercut driving rod-guide groove 20 in the closure 2 and which carries a latching element such as a dog 21 which may be engaged and disengaged with a catch 22 mounted to the fixed frame 1 by displacement of the slide 19 within the driving rod guide groove 20.

The movement of the slide 19 (and with it that of the dog 21 relative to the catch 22) is made by means of an elongated actuating element such as a driving rod 23 which is also housed within the driving rod guide groove 20 of the closure 2 and engages the slide 19 by a hole-and-pin coupling 24.

The other end of the drive rod 23 is also coupled to the slide by a hole-and-pin coupling 25, which also runs along the undercut driving rod guide groove 20 of the closure 2. The slide 26 carries a pivot pin 27 on which is pivotally supported on arm 28' of an extending means such as a toggle mechanism 28. A second arm 28'' of the toggle mechanism 28 is pivotally connected by a pivot pin 29 to the support bearing 30, which is housed in the driving rod guide groove 20 of the closure 2 and is secured there by an adjusting screw 31 against displacement. The opposite ends of arms 28' and 28'' of toggle mechanism 28 are connected by a pivot pin 28'''.

Figure 3:
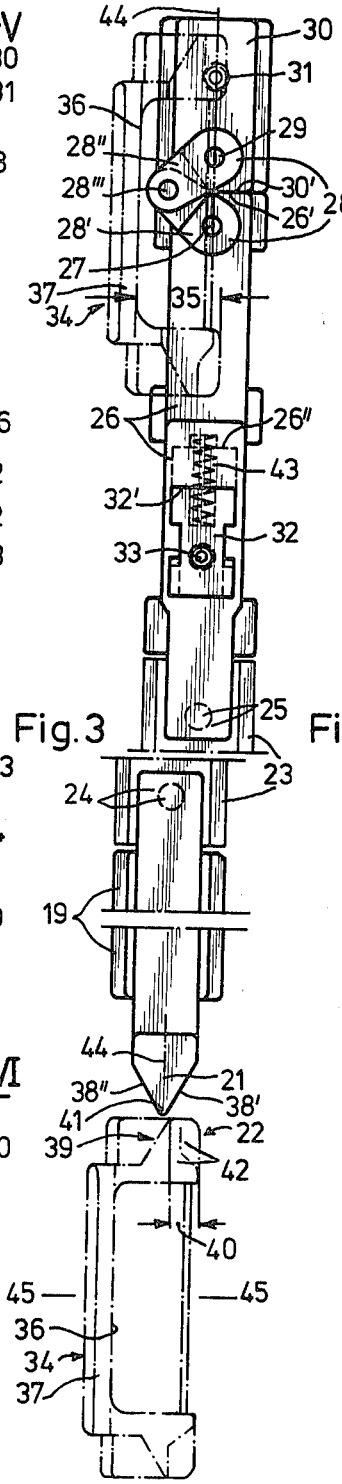
FIG. 3 is an elevational view of the edge center closure locking device looking in the direction of arrow III of FIG. 2.
Figure 4:
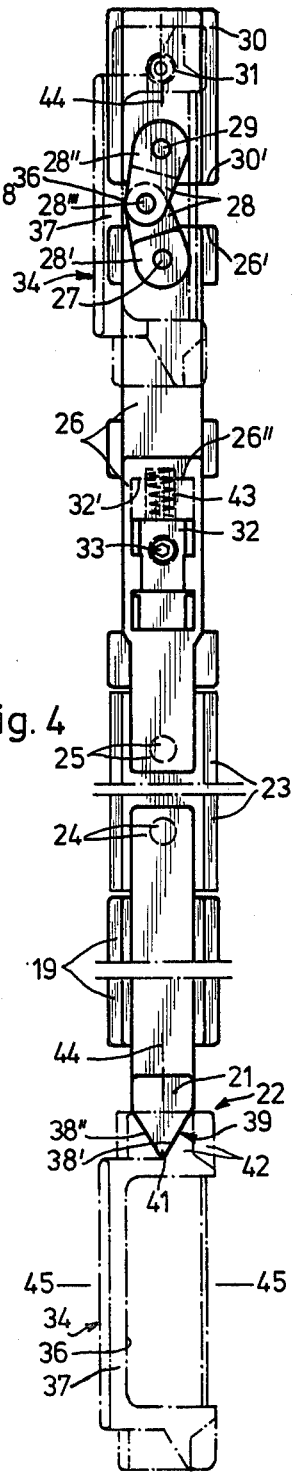
FIG. 4 is a view similar to FIG. 3, but with the central closure locking device in the locked condition.

The maximum folded position of the toggle mechanism 28, as can be noted from FIG. 3, is determined by the abutting of the two oppositely facing end surfaces areas 26' and 30' of slide 26 and the support bearing 30, respectively. The approximate extended position of the toggle mechanism 28, (as can be seen in FIG. 4) is determined by limiting the path of the slide 26. The slide 26 has an end surface 26'' which engages an end surface 32' of a stop 32 which is fixed within the driving rod guide groove 20 of the closure 2 by an adjusting screw 33.

To prevent a complete extending or straightening of the toggle mechanism 28, the support bearing 30 is equipped with a tongue-type extension facing the slide 26. This tongue engages the slide 26 from the underneath and acts together with the pivot pin 27 extending somewhat from the slide 26 through a slotted hole. By a corresponding dimensioning of the slotted hole, the adjusting path of the slide 26 is so restricted relative to the support bearing, that the toggle mechanism 28 can only take the position shown in FIG. 4. Consequently, its total straight or fully extended position is never reached. The tongue, which acts as a slide limiting device, can be made from relatively thin material, such as a steel spring blade and may be riveted to the pivot pin 29.

The toggle mechanism 28 acts as an actuating mechanism along with a control cam 34 which is fixedly-mounted on the frame 1.

In FIG. 1 it can be seen that the control cam 34 for operating the edge center closure latch 17 is arranged a certain distance beneath the support bearing 7 of the extension bracket 6 on the stile of the fixedly-mounted frame 1. The corresponding control cam 34 for operating the edge center closure latch 18 is mounted in a vicinity of the closure or hinge side, lower corner of the fixed frame 1 beside the engagement part of the tilt locking device 11.

Figure 5:
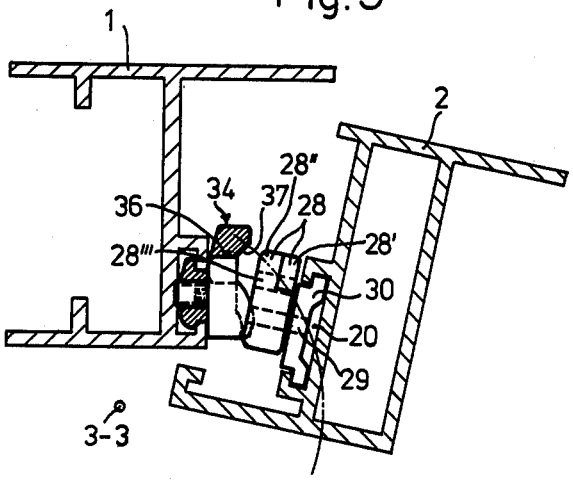
FIG. 5 is a horizontal cross-sectional view taken on the line V—V of FIG. 2.
Figure 7:
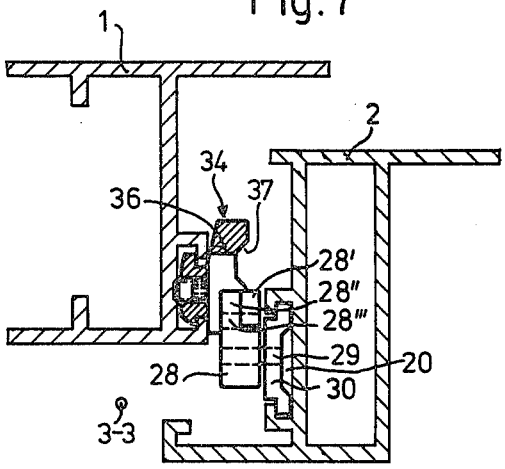

FIGS. 3 and 5 show that the control cam 34 is set at a certain distance 35 relative to the room side face area of the fixed frame 1 and incorporates an abutment action surface 36 at such distance which is parallel with the plane of the frame and adjacent a diagonal, rearwardly-sloping cam action surface 37, as can be clearly seen in FIGS. 5 and 7.

The control member 21 mounted on the slide 19 shown in FIGS. 2 and 8 (and especially shown in FIGS. 3 and 4) has a V-shaped end symmetrical about the longitudinal center line 44 of the slide 19 and which has two oppositely sloping locking surfaces 38', 38''.

When the slide 19 is moved downwardly from the position shown in FIG. 3 to the position shown in FIG. 4, surface 38' engages a correspondingly-sloped surface 39 of the catch 22. Herein, the catch 22 is integral with cam 34, a second of which is mounted on the frame 1 in such a way that the upper point of surface 39 lies a distance 40 from the roomside face area of the fixed frame 1. This distance is considerably smaller (for example, ⅔ smaller) than the distance 35 of surface 36 on the first or control cam 34 from its corresponding area.

In FIG. 3, the window is indicated with the closure 2 located in a slight tilted-open position relative to the fixed frame 1; that is, the slide 19 with the dog 21 is in "disengaged" position relative to the catch 22. The relationship between the closure 2 and the fixed frame 1, however, is still such that the apex 41 formed between the two surfaces 38' and 38'' is positioned a certain distance behind the "room side" frame face area. This distance is greater than the distance 40 to the top of the surface 39 of the catch 22, as shown in FIG. 3.

If the closure 2 is now pushed further in the direction of closing, the toggle mechanism 28 is extended as shown in FIG. 4. The toggle mechanism 28 engages the action surface 36 of the fixed control cam 34, causing a slow extending or straightening of the toggle mechanism 28 until it reaches the position shown in FIG. 4. The result is a forced controlled lengthwise movement of the slide 26. The slide 26 pushes the slide 19 through the driving rod 23 in the same direction and pushes the dog 21 by the forceable contact of its lock surface 38' with the surface 39 of the catch 22.

When the closed position of the closure 2 in the fixed frame 1 is completed, and the drive rod brace 8 is operated by the service handle 9, the coupling device 13 and the locking device 14 are engaged; prior to that time the toggle mechanism 28 activates a force blockage of the latch 17 in its engaged position by means of the control cam 34.

This method of operation of the edge center latch formed by the toggle mechanism 28, as well as the latch 21 and the catch 22 for the latch 17, is also made clear by FIGS. 7 and 8 of the drawing.

Figure 6:
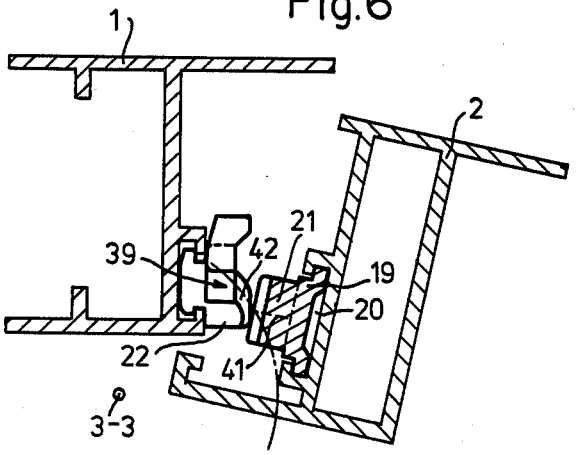
FIG. 6 is a horizontal cross-sectional view taken along line VI—VI of FIG. 2, FIGS. 7 and 8 are views similar to those of FIGS. 5 and 6, respectively, but with the wing opened partially about the tilt axis.

By moving the closure 2 around its vertical side axis 3—3, the adjusting part formed by the toggle mechanism 28 and the control cam 34 (on one hand) and the lock area 38' of the lock dog 21 with the catch 22 (on the other hand) is brought into engagement and disengagement with curved surface 42, as shown in FIGS. 5 and 6.

During a slight swing angle of the closure 2 about the vertical axis 3—3, the linkage of the toggle mechanism 28 moves away from the action surface 36 over surface 37 of the control cam 34 so that the locking surface 38' of the dog 21 can be moved away from the engaging surface 39 of catch 22.

So that locking of latch 17 is prevented, during closing of the closure 2 from the swing position about the axis 4—4, the catch 22 is designed with a rounded surface 42 at the front, which cooperates with the lock surface 38' in such a way that, when they hear, a small longitudinal movement of the slide 26 within the driving rod guide groove 20 is effected. Inadvertant locking of the center closure latching mechanism during closure of the closure 2 from the swing position about the axis 4—4, is, therefore, effectively prevented.

The operation of the edge center closure latch 18 is basically the same as for the edge center closure latch 17; the only difference is that the moving operations which occur on the edge center closure latch 17 during the turn-movement about the axis 3—3 are made on the closure latch 18 during the tilt-movement of the closure about the axis 4—4. Also, the moving operations which occur on the center closure latch 17 during the swing-movement about the axis 4—4 are made on the closure latch 18 during the turn-movement of the closure about the axis 3—3. A spring 43 extends between the stop 32 and the slide 26 for biasing the slide 26, while the closure 2 is open, to that position which corresponds to the folded position of the toggle mechanism 28. The center closure latches 17 and 18 are thereby prevented from being brought inadvertently manually into a non-functional position, and it is assured that the center closure latches, during opening of the closure 2, reach their release position automatically.

FIGS. 3 and 4 also show that the wing side functional parts of the latches 17 and 18 are designed symmetrically of the longitudinal center plane 44—44 and are, therefore, suitable for right and left handed mounting. The only thing which requires attention is that the folded position of the toggle mechanism 28, during insertion of the parts into the driving rod-guide groove 20, is folded toward the control cam.

FIGS. 3 and 4, it is also evident that the lock cam 22 and the control cam 34 are arranged in such a way that they are symmetrical to a horizontal plane 45—45 and designed so that the lock cam 22 and control cam 34 permit selective right and left-handed usage.

The first modified center closure latch, as shown in FIGS. 9 and 10, differs from the one shown in FIGS. 2 and 8, basically by a different design of the dog. The dog of the preferred embodiment is replaced in the first modified center closure latch by a dog member 46 connected to a pivot pin 47 which pivotally connects two arms 48' and 48" of a toggle mechanism 48. The arms 48' and 48" of the toggle mechanism 48 are pivotally supported on pivot pins 49 and 50, respectively. The pivot pin 49 is mounted on a slide 51 which is coupled to the drive rod 23 and the pivot pin 50 is fastened in fixed support bearing 52 which is fastened by a fastening screw 53 within the drive rod-guide groove 20 (not shown) of the closure.

The toggle mechanism 48 is arranged so that it is folded in the direction opposite the toggle mechanism 28. When the toggle mechanism 28 assumes its folded or bent position, the toggle mechanism 48 is close to its extended position (FIG. 9). However, if the toggle mechanism 28 is in its extended position, the toggle mechanism 48 is in its folded position (FIG. 10).

The dog member 46 mounted to the toggle mechanism 48 is moved by the folding movement of the toggle mechanism 48 behind a stationary catch 54 and along a track which corresponds to the arc of a circle around the pivot pin 50. In that way, the dog member 46 introduces a force component to the catch 54 that is mainly transverse to the plane of the window, thus forcing the closure 2 into closure position against the fixed frame.

FIGS. 11 and 12 show a second modified edge center closure latch in which, in place of the toggle mechanism 28 of the preferred embodiment, a roller-column 55 is provided with a variable active length as a cam follower mechanism for operation of the center closure latches 17 and 18. The individual rollers 56 of this roller column are rollers or balls which are enclosed in a guide channel 57 which is closed in the cross-sectional direction. In that way, one end of the guide channel 57 is closed so that the rollers of the column 55 have a fixed resistance. In a predetermined area, the guide channel 57 contains a side opening 58 and in that opening at least one (but preferably several) of the rollers 56' may be displaced laterally of the longitudinal axis of the roller column 55. These rollers 56' cooperate with a slide 59, which is movable against the force of a compression spring 60 extending laterally of the longitudinal axis of the roller column 55.

The slide 59 acts with a stop 61 mounted on the fixed frame 1. With the closure 2 in open condition, the slide 59 takes the position shown in FIG. 11, i.e., it is biased towards the left side by the spring 60, as soon as the closure in its beginning movements toward opening, moves to the right from the stop 61. In that way, the rollers 56' are positioned beside the roller column 55, so that it has its shortest possible length.

When the closure 2 moves toward the closed position relative to the fixed frame 1, the slide 59 touches the stop 61 and is pushed toward the right side against the action of the spring 60. In that way, the rollers 56' are pushed into the roller column 55 from the side, so that the column extends itself against the action of spring 63 to a predetermined length. In this case, the column acts within the guide channel 57, on the slide member 62 which is connected to the drive rod 23 which moves the slide 19 which carries the control member 21.

In order that the slide member 62 be guided automatically back to its starting position, when the slide 59 is pushed by the spring 60 into the position of FIG. 11, the slide member 62 is biased upwardly by springs 63 which are supported in the housing and positioned within the guide channel 57.

Latching mechanism of the type described and shown on the drawings may be used on windows, doors, etc. with turn-or turn-tilt wings particularly when the edges close to the installation area of the center closure between wing and fixed frames do not leave sufficient space for the incorporation of corner tracks.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patents is:

1. Latching mechanism for a planar closure which is hingedly mounted on a frame for swinging movement about one side of the frame between an open position and a closed position relative to the frame, said latching mechanism comprising:

(a) a control cam fixed to the hinge side of the frame,
(b) a catch fixed to the hinge side of the frame and spaced from the control cam,
(c) a driving rod slidably mounted for movement along its longitudinal axis within the plane of the closure on the hinge side of the closure,
(d) a dog mounted on one end of the driving rod for latchingly engaging the catch,
(e) biasing means operatively connected to the driving rod for urging the dog away from latching engagement with the catch, and
(f) a cam follower mechanism connected to the opposite end of the driving rod adjacent the control cam and engageable with the control cam when the closure moves from the open position to the closed position for moving the driving rod axially in opposition to said biasing means to position the dog for latching engagement with the catch and into latching engagement with the catch.

2. Latching mechanism as recited in claim 1, wherein the dog and catch have cooperating cam surfaces for providing lateral motion of the catch and closure relative to the plane of the closure as the dog is moved into latching engagement with the catch.

3. Latching mechanism as recited in claim 1, wherein the cam follower mechanism is a toggle mechanism comprising:

(a) a first arm, one end of which is pivotally connected to the closure, and
(b) a second arm, one end of which is pivotally connected to the driving rod and the other end of which is pivotally connected to the other end of the first arm, said arms being urged into a folded position by the biasing means so that the ends of the arms which are pivoted together extend toward the control cam, so that the arms are moved to an extended position by the control cam to move the drive rod axially.

4. Latching mechanism as recited in claim 1, wherein the dog is a toggle mechanism, comprising:

(a) a first arm, one end of which is pivotally connected to the closure, and
(b) a second arm, one end of which is pivotally connected to the driving rod and the other end of which is pivotally connected to the other end of the first arm, said arms being in a substantially extended position when the closure is in the open position and a substantially folded position so that the ends of the arms which are pivoted together extend toward the catch for latchedly engaging the catch.

5. Latching mechanism as recited in claim 1, wherein the cam follower mechanism comprises:

(a) a housing having a guide channel which has a longitudinal axis which is parallel with the longitudinal axis of the driving rod, said housing also having a side opening which extends transversly from the guide channel toward said control cam, (b) a plurality of rollers freely disposed in a column in the guide channel and said opening, the rollers in said side opening being shiftable from the opening to the channel to increase the length of the column of rollers in the channel and back to the side opening to decrease the length of the column, said biasing means being effective to force some of the rollers into the side opening to shorten the column while simultaneously urging the dog for latching engagement with the catch, and (c) a plunger slidably mounted in the side opening, said plunger having an inner surface in contact with the rollers in the opening and an outer surface for engaging the control cam, so that movement of the closure from the open position to the closed position causes the plunger to be pushed by the control cam toward the guide channel to force the rollers in the side opening into the column in opposition to the biasing means to lengthen the column and bring the dog into latching engagement with the catch.

6. Latching mechanism for a planar closure which is hingedly mounted on a frame for selectively swinging between a closed position and an open position relative to the frame about a vertical axis along one vertical side of the frame, and swinging relative to the frame about a horizontal axis along one horizontal side of the frame, said latching mechanism, comprising:

(a) a control cam fixed to one hinge side of the frame, (b) a driving rod slidably mounted on the side of the closure which faces said one hinge side of the frame, said driving rod being mounted on the closure for sliding movement along its longitudinal axis within the plane of the closure, (c) a catch fixed to said one hinge side of the frame spaced from the control cam, (d) a cam follower connected to one end of the driving rod for engaging said control cam and moving the driving rod longitudinally toward said catch when the closure swings from the open position to the closed position, (e) biasing means operatively connected to the driving rod for urging the cam follower into engagement with the control cam, and a catch fixed to said one hinge side of the frame spaced from the control cam, (f) a dog attached to the opposite end of the driving rod for latchedly engaging the catch when the closure reaches its closed position.

7. Latching mechanism as recited in claim 6, wherein the dog and catch have cooperating cam surfaces for providing lateral motion of the catch and closure relative to the plane of the closure as the dog is moved into latching engagement with the catch.

8. Latching mechanism as recited in claim 6, wherein the cam follower mechanism is a toggle mechanism comprising:

(a) a first arm, one end of which is pivotally connected to the closure, and (b) a second arm, one end of which is pivotally connected to the driving rod and the other end of which is pivotally connected to the other end of the first arm, said arms being urged into a folded position by the biasing means so that the ends of the arms which are pivoted together extend toward the control cam, so that the arms are moved to an extended position by the control cam to move the drive rod axially.

9. Latching mechanism as recited in claim 6, wherein the dog is a toggle mechanism, comprising:

(a) a first arm, one end of which is pivotally connected to the closure, and (b) a second arm, one end of which is pivotally connected to the driving rod and the other end of which is pivotally connected to the other end of the first arm, said arms being in a substantially extended position when the closure is in the open position and a substantially folded position so that the ends of the arms which are pivoted together extend toward the catch for latchedly engaging the catch.

10. Latching mechanism as recited in claim 6, wherein the follower comprises:

(a) a housing having a guide channel which has a longitudinal axis which is parallel with the longitudinal axis of the driving rod, said housing also having a side opening which extends transversly from the guide channel toward said control cam, (b) a plurality of rollers freely disposed in a column in the guide channel and said opening, the rollers in said side opening being shiftable from the opening to the channel to increase the length of the column of rollers in the channel and back to the side opening to decrease the length of the column, said biasing means being effective to force some of the rollers into the side opening to shorten the column while simultaneously urging the dog from latching engagement with the catch, and (c) a plunger slidably mounted in the side opening, said plunger having an inner surface in contact with the rollers in the opening and an outer surface for engaging the control cam, so that movement of the closure from the open position to the closed position causes the plunger to be pushed by the control cam toward the guide channel to force the rollers in the side opening into the column in opposition to the biasing means to lengthen the column and bring the dog into latching engagement with the catch.

* * * * *